US012005297B2

(12) United States Patent
Pence et al.

(10) Patent No.: US 12,005,297 B2
(45) Date of Patent: Jun. 11, 2024

(54) JUMP BOX

(71) Applicants: Jacob Pence, Swansboro, NC (US); Ryan Floyd, Honolulu, HI (US)

(72) Inventors: Jacob Pence, Swansboro, NC (US); Ryan Floyd, Honolulu, HI (US)

(73) Assignee: Ronin Jump Box LLC, Swansboro, NC (US)

( * ) Notice: Subject to any disclaimer, the term of this patent is extended or adjusted under 35 U.S.C. 154(b) by 3 days.

(21) Appl. No.: 17/159,292

(22) Filed: Jan. 27, 2021

(65) Prior Publication Data

US 2021/0228937 A1 Jul. 29, 2021

Related U.S. Application Data

(60) Provisional application No. 62/966,651, filed on Jan. 28, 2020.

(51) Int. Cl.

| | |
|---|---|
| ***A63B 21/00*** | (2006.01) |
| ***A63B 21/062*** | (2006.01) |
| ***A63B 23/035*** | (2006.01) |
| ***A63B 23/04*** | (2006.01) |

(52) U.S. Cl.

CPC ..... *A63B 21/4033* (2015.10); *A63B 21/0626* (2015.10); *A63B 21/151* (2013.01); *A63B 23/03525* (2013.01); *A63B 23/0405* (2013.01); *A63B 2225/093* (2013.01)

(58) Field of Classification Search

CPC ..... A63B 23/0458; A63B 23/0464; A63B 23/032525; A63B 2225/093; A63B 5/00; A63B 5/08; A63B 5/16; A63B 21/00047; A63B 21/00178; A63B 21/0023; A63B 21/4011; A63B 21/4015; A63B 21/4027; A63B 21/4029; A63B 21/4033; A63B 21/4034; A61H 1/0229; A61H 3/00; A61H 3/02–04; A47C 12/00

See application file for complete search history.

(56) References Cited

U.S. PATENT DOCUMENTS 4,150,851 A * 4/1979 Cienfuegos ..... B62K 19/36 248/408
4,564,193 A * 1/1986 Stewart ..... A63B 23/1209 482/142
5,118,101 A * 6/1992 Belli ..... A63B 5/00 482/52
5,161,640 A * 11/1992 Holbrooks ..... B60R 3/007 280/165

(Continued)

*Primary Examiner* — Zachary T Moore
(74) *Attorney, Agent, or Firm* — Russell D. Nugent; The Humphries Law Firm, PC

(57) ABSTRACT

A jump box for training athletes that eliminates a lot of the hazards of using a traditional jump box. The device has a base, a back frame and a platform the height of which can be adjusted in small increments. The platform is sized and shaped to extend further towards the athlete than any other portion of the jump box making it considerably safer than other devices on the market. In addition, the platform of the jump box is angled downward slightly to make it easier for the athlete to jump on the device. The weight and construction of the device makes it virtually impossible to knock over. In addition, because of the shape and orientation of the platform, athletes can use the box without injuring themselves if they miss a jump.

10 Claims, 5 Drawing Sheets

(56) References Cited

U.S. PATENT DOCUMENTS 5,273,505 A * 12/1993 Jones ..... A63B 21/0615 482/133
5,277,675 A 1/1994 Shifferaw
5,316,528 A * 5/1994 Ziparo ..... A63B 21/4029 482/52
5,634,870 A 6/1997 Wilkinson
5,645,078 A * 7/1997 Marmer ..... A63B 21/4035 600/595
5,683,331 A 11/1997 Dalebout
D390,713 S * 2/1998 Chen ..... D6/374
6,145,524 A * 11/2000 Li ..... A61H 3/00 135/69
6,524,355 B1 2/2003 Jenkins
6,561,954 B1 * 5/2003 Smith ..... A63B 5/00 482/14
6,926,365 B2 * 8/2005 Bottoms ..... A47C 9/025 297/488
7,070,540 B1 7/2006 Priester
7,104,901 B1 * 9/2006 Mason ..... A63B 69/0022 473/478
7,509,966 B2 * 3/2009 Karasin ..... A61H 3/00 135/66
7,637,851 B1 * 12/2009 Lormil ..... A63B 21/4035 482/141
7,780,586 B2 * 8/2010 Gates ..... A63B 26/00 482/142
8,056,979 B2 * 11/2011 McBride ..... A61H 1/0218 297/344.18
8,216,114 B1 * 7/2012 Wynn, III ..... A63B 21/00047 482/52
8,246,521 B2 8/2012 Alexander et al.
8,986,172 B2 3/2015 Poole
9,107,503 B2 * 8/2015 Kline ..... A47C 7/008
10,188,901 B1 * 1/2019 Cassidy ..... A63B 21/4034
10,532,239 B1 * 1/2020 Suarez Monne ..... A63B 17/04
2006/0030434 A1 * 2/2006 Horkan ..... A63B 69/408 473/438
2007/0021272 A1 1/2007 Slade
2009/0137372 A1 * 5/2009 Gates ..... A63B 21/078 482/142
2011/0218086 A1 * 9/2011 Boren ..... A61H 1/0229 482/142
2011/0278808 A1 * 11/2011 Kline ..... A61H 3/04 280/43
2014/0137912 A1 * 5/2014 Kline ..... A61H 3/04 135/67
2015/0258414 A1 9/2015 Auerbach
2016/0279459 A1 * 9/2016 Walker ..... A63B 21/4047
2017/0050101 A1 2/2017 Ruscombe-King
2017/0209735 A1 * 7/2017 McCall, Jr. ..... A63B 21/4029
2017/0246504 A1 * 8/2017 Simmons ..... A63B 23/047
2017/0368403 A1 * 12/2017 Pennington ..... A63B 21/0724
2018/0169454 A1 * 6/2018 Bowman ..... A63K 3/043
2018/0207464 A1 7/2018 Long
2018/0229098 A1 8/2018 McCorkle
2019/0168051 A1 * 6/2019 Hausheer ..... A63B 71/0036
2020/0171344 A1 * 6/2020 Monti ..... A63B 21/4029

* cited by examiner

JUMP BOX

BACKGROUND OF THE INVENTION

(a) Field of the Invention

The present invention is in the technical field of exercise equipment. More particularly, the present invention is in the technical field of training devices that are used to train athletes to jump.

(b) Background Art

Box jumping has been a very popular and widely used means of training athletes for years. Box jumping was introduced to the United States by Fred Wilt who reportedly watched Russian athletes preparing for track and field events by jumping. Impressed with their performance, Fred Wilt teamed up with Micharel Yessis to share the information that he had learned training Russians with the rest of the world. Box jumping not only provides an athlete with practice jumping vertically, but it helps athletes to develop leg strength, speed and endurance and helps the athlete train for their own sport as well as other sports as most sporting activities have the potential to require some form of jumping. It also helps develop coordination and is an excellent way to burn calories.

However, it is well known among athletes and trainers alike that box jumping is dangerous. There is such a large potential for injury that some trainers will not allow their athletes to perform box jumping exercises. While these trainers will generally admit that box jumping is good for certain things, it can cause injuries to a number of different body parts. One of the more common injuries resulting from missing the box or falling off it are cuts and other injuries to the legs, particular the shins. In cross-training circles these injuries are so common they are considered a rite of passage. In addition, box jumping puts a lot of strain on bones and tendons. ACL tears are also common injuries suffered while box jumping. Moreover, if the athlete does not have the hip mobility necessary to raise their feet high enough, they can strain their backs when jumping. Last but certainly not least, several injuries occur simply as a result of either missing the box or falling off it. Falling from even a modest height can result in career ending injuries including back and head injuries and broken bones. Finger and hand injuries are also common because of falls while box jumping. As a result, a lot of trainers and gyms simply forgo this training method as being too dangerous.

Naturally, there have been a number of attempts to develop devices that allow athletes to perform these exercises while minimizing the risk of injury, but the prior art devices are inadequate for these purposes. One of the more traditional and popular jump box devices is a three-dimensional trapezoid shaped structure that is seated on the floor resting on its largest face or surface. These devices have sharp corners and are prone to being knocked over or "kicked out" during use, i.e. the athlete can push the box over with their feet if they do not land squarely enough on the box. Because these devices are stand-alone devices and are designed to be light enough to be movable, they do not have the stability necessary for athletes to jump onto them without risking knocking the device over. In addition, the edge and corners on such devices can cause significant injuries to the athlete that encounters them while jumping.

Another common jump box device consists of a box shaped like a rectangular prism or a three-dimensional rectangle. These devices are meant to rest on any of their sides and since each side is a different length, the athlete can adjust the height of the box by turning it on one side or another. As with the device above, these devices are easy to knock over during use and have the same corners and edges that cause injury. The device necessarily has to be lightweight enough that the average user can turn the device to rest on different sides and, as a result, is prone to being knocked over during use.

Other devices consist of smaller units that are meant to be stacked on top of each other to make the device the appropriate height. For example, there are steel "plyo" boxes that consist of metal stools with tapered legs that flare out to a degree from the platform to which they are attached. These boxes may be more stable than other devices simply because they are constructed of heavier materials and because of the positioning of their legs, but they have the same sharp edges and corners that injure athletes all the time. In addition, the athlete has further forward to jump to get to the platform por top of the plyo box because the legs flare outward from the top of the device. Their main advantage over some other devices is that they are stackable; however, they are still lightweight enough to be knocked over by someone attempting to jump on them. In addition, some athletes stack plastic stair steppers or foam boxes on top of each other. These devices are simply too lightweight to provide a stable platform for an athlete to jump on or off.

So there is a catch-22 in the industry—either make the jump box out of a lightweight material that is soft and will not injure an athlete who encounters a corner or an edge of the box or make the device out of sturdy materials like wood or metal that are heavier and harder to knock over, but increase the potential for injury. The device described below eliminates these hazards.

BRIEF SUMMARY OF THE INVENTION

All of the above-described devices present a significant risk of injury to the person using them. The inventors of the present device have been working in the personal training field for over 20 years and have developed a much safer device for use as a jump box. More specifically, the device consists of an adjustable platform fixed to a frame. The frame has at least three, if not four, basic parts. The first part, or base of the frame, is oriented horizontally that is meant to rest flush against a floor or similar surface. The second part, or the back frame, is vertically oriented and attached to a portion of the base of the frame. Third, there is a platform onto which a user jumps, the height of which is adjustable. In addition, preferred embodiments of the device feature handlebars that also serve to provide support to the back frame. For reference, the front of the device is the portion of the device, including the platform, that is opposite the back frame (vertical supports). The front of the device is the portion of the device that is configured to face the user when in use.

The base of the frame is made up of one or more legs and one or more horizontally oriented crossbars connecting the two legs. Preferred embodiments of the device feature two legs configured to rest flush against the ground or other surface and are connected by a crossbar at or near one end of the leg. Additional crossbar(s) can be positioned to attach to each leg at either end at a point between the ends of each leg. Preferred embodiments of the device have two legs, joined by a crossbar at the end of the device that also features the vertical supports described below, such that the legs are not parallel, but rather "spread out" or diverge from each other as they extend away from the back frame of the device. That allows the user more room to stand closer to the platform when preparing to jump and thereby decreases the likelihood that the user misses or the platform when jumping. The legs provide necessary support to the device without requiring the athlete to jump over or past a portion of the base of the frame to reach the platform. This is a critical feature of the invention. One of the reasons this device is so much safer than devices that are currently on the market is that the user does not need to jump past a portion of the jump box or device to get to the platform. In the prior art examples above, the steel "plyo" boxes have legs that extend outward as they extend downward away from the platform. The extra distance that these legs occupy forces the athlete to jump forward to clear that area and reach the platform. This extra distance, while it may be small, can lead to a lot of failed jumps.

Preferred embodiments and the inventors' anticipated best mode of the device include an additional leg extending in a different direction from the other legs as part of the base. These embodiments can include a T-shaped leg that extends from the crossbar away from the base of the device in the direction opposite the direction the other two legs extend. Still other embodiment may involve this leg being pivotably mounted onto the base of the device such that the user can fold the T-shaped leg up towards the rest of the device to get it out of the way when desired—when attaching the device to or positioning it against a wall for example.

The base of the frame is connected to one or more vertical supports which are vertically oriented portions of the frame that provide support for the platform as well as the means to adjust the height of the device. Since this portion of the frame is meant to be farther away from the user than the rest of the device, it is referred to as the back of the frame or back frame.

The back frame can be made in any number of configurations so long as it provides structural support for the rest of the device. Preferred embodiments include one or more vertical supports that are connected at one end to the base of the frame. Preferred embodiments of the device include one or more horizontal crossbars to which one or more vertical supports are attached at the end opposite the base of the device.

In addition, these vertical supports feature means to adjust the height of the platform that it supports, i.e. a height adjustment system. In preferred embodiments, the height adjustment system includes one or more of the vertical supports featuring a plurality of holes in their surfaces which can be used to attach other structures to the frame of the device. Preferred embodiments of the device also use a cable system that is operably connected to one or more pins that are configured to fit into the holes on the vertical supports and are used to adjust the height of the platform. In preferred embodiments, the device features one or more pins that configured to fit into holes featured on a portion of the one or more vertical supports. The cables are connected to the pins by springs. When the user pulls on cables located on either side of the platform, the springs stretch and pull their respective pins out of their respective holes. The user is then able to move the platform up or down with respect to the rest of the device and align it with another set of holes. At that point the cables can be released, the springs will compress to a relaxed state and the pins will insert into another set of holes thereby supporting the platform at a different height. In this manner, the user can change the height of the platform in small increments. In preferred embodiments of this device, the holes in the vertical supports are located one inch apart thereby allowing the user to adjust the height of the platform in one-inch increments. While there is a practical limitation to how close the holes can be positioned to each other, a skilled artisan can appreciate that the increments by which the height of the platform can be adjusted can be more or less than one inch.

Preferred embodiments and the inventors' anticipated best mode of the device feature a counterweight system operably connected to the platform. This counterweight system can be integrated into some of the vertical supports that make up the back frame or it can be placed in a separate housing that is also vertically mounted to the device and in preferred embodiments, is integrated into the back frame. The counterweight system consists of a cord or line of some sort connected to one or more weights at one end and connected to either a portion of the platform or a structure that is attached to the platform. The counterweight system usually includes passing the one or more cords over one or more pulleys. This counterweight system supports the platform when it is not connected to the height adjustment system, when the user is adjusting the height for example. The counterweight being operably connected to the platform provides a force that at least partially overcomes the force of gravity when the platform is not attached to the one or more vertical supports. Therefore, detaching the platform does not result in the platform immediately falling to the ground under its own weight.

An additional or top handrail can be added to the back frame of the device to make the device easier to move. In preferred embodiments and the inventor's anticipated best mode of the device, the device features one or more wheels attached to the base of the frame and the top handrail attached to the crossbar featured at the top of the back frame/vertical supports. These structures allow the device to be tipped backwards like a dolly or hand truck, and the user can grip the third handrail and pull the device along the floor using the wheels. Preferred embodiments also feature padding on this top handrail in case the user falls forward and comes into contact with it accidentally. Padding can be placed on the exterior of the handrails as well for the same reason.

The structure of the platform itself can be modified a number of different ways, but in essence it is a flattened structure that supports the athlete when they jump on to the device. As discussed above, the platform features structures, such as pins, that engage with structures, such as holes, on the vertical supports of the back frame. In these embodiments, the only portion of the device that the platform is attached to is the back frame via this attachment system. The height of the platform is adjusted by removing and then inserting the pins from the holes in the platform and the back frame after they have been positioned to align with each other as discussed above.

In addition, some embodiments of this device feature a platform that is angled downward slightly (five degrees or less) towards the user to make it easier for the athlete to reach the platform. This is a critical feature of the device in those embodiments that contain this feature as the angling of the platform makes it easier for the athlete to clear the front of the platform with their feet when jumping on the device. Being able to clear the front of the device greatly reduces the potential for injury. Moreover, the angling of the platform reduces injury for those athletes that do not jump high enough to get their feet on the platform and instead hit the edge of the platform with their shins or knees. Because the platform is angled downward, if the athlete contacts the edge of the platform with their shins or knees, they are not striking the edge at a 90-degree angle; thereby, reducing the potential for injury further.

As discussed previously, the back frame contains vertical supports featuring the adjustment system. These vertical supports are attached to the base of the frame at one end and a horizontal crossbar at the other end. This crossbar is the top of the back frame and the top of the device itself. Preferred embodiments of this device have handlebars that attach to the base of the frame at points that are further "forward" of the points of attachment for the set of vertical supports. In this case forward means closer to the front of the device as defined above. In preferred embodiments, these handlebars are rounded both in cross section and along their longitudinal axis. In these embodiments, the handlebars extend horizontally out from a vertical support bar that is part of the back frame for a distance than then curve downward to meet the base of the frame.

Moreover, there are other aspects that make this device a safer jump box. For example, the platform features rounded edges at the "corners" of the platform and the platform itself is padded. Preferred embodiments and the inventors' anticipated best mode of the device include a vinyl covering or other covering that works to pad the platform and prevent injury if some portion of the athlete other than the bottoms of their feet come into contact with the platform. The covering can also feature a textured surface to help the athlete's feet or footwear to grip the surface of the platform. In addition, by fixing the platform to the frame, the inventors have eliminated a large amount of the device's surface area, namely the structures that would normally extend down from the platform forming surfaces for the athlete to contact and thus injure themselves on. Moreover, the legs and crossbars that make up the base of the device can feature padding as well to prevent or reduce injury from any coming into contact with those structures if and when they fall.

The device weighs approximately 300 pounds and as a result, has the weight necessary to support large athletes jumping on top of it. In addition, the platform and frame have means to adjust the height of the platform by one-inch increments. None of the devices on the market that have some ability to alter the height of the box do so in one-inch increments. Adjusting the height of the prior art devices involves replacing one device with a taller or shorter device, stacking or unstacking more devices on top of each other or turning the device on its side. Some jump fails and their resulting injuries are a result of the athlete trying to increase the height of their jump by too large of an increment. Finally, there are means to attach the device to a wall to provide additional stability and to make the device, which is already exceedingly difficult to knock over, if not impossible to knock over. Most of the prior art devices cannot be attached effectively to a wall and used as attaching them to the wall will prevent adjusting the height of the device. These and other advantages will become apparent as a result of the detailed description below.

DETAILED DESCRIPTION OF THE INVENTION

Figure 1:
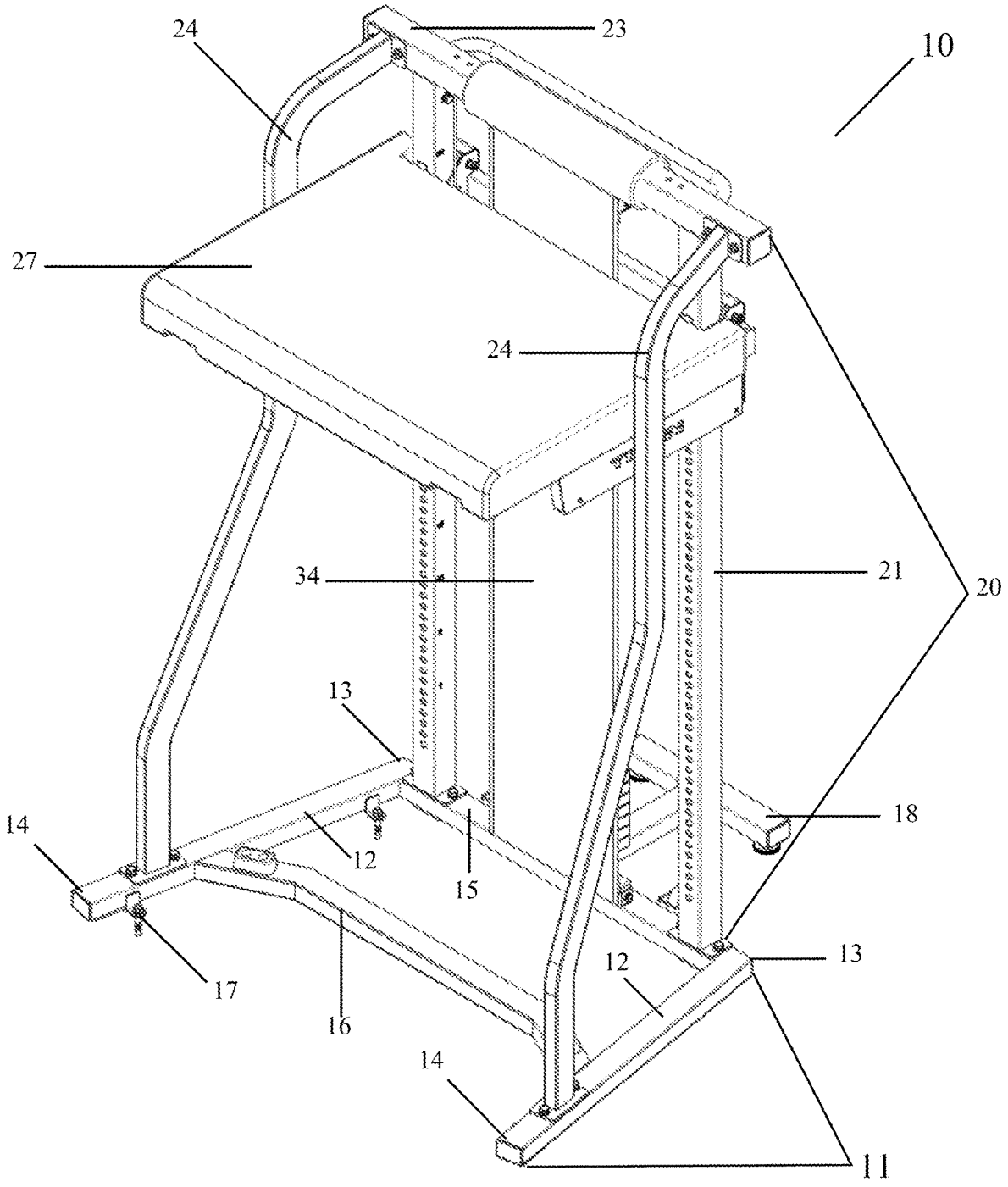
FIG. 1 is a right-side perspective view of a preferred embodiment of the jump box device.

Referring now to the invention in more detail, in FIG. 1 there is shown a preferred embodiment of the presently disclosed jump box. FIG. 1 shows the base 11 of the device 10 which in this embodiment is made of a plurality of metal bars with a square-shaped or rectangular-shaped cross section joined together to form a frame. While a skilled artisan could appreciate that the base 11 of the device 10 could take a number of different forms, in preferred embodiments, the base consists of two legs 12 each having a distal end 13 and a proximate end 14. The proximate end 14 is the end that is farthest away from the back frame 20 and vertical supports 21. The distal end 13 of each leg 12 is attached to a first crossbar 15 that connects to the vertical supports 21.

In preferred embodiments, the legs are not "square." That is to say that the angle formed between the first crossbar 15 and the distal end 13 of each leg 12 attached to that same distal end 13 of a leg 12 is more than 90 degrees. In other words, the legs 12 are positioned to flare outward at their proximate ends 14; the proximate ends of the legs 12 are farther away from each other than the distal ends 13 of the same legs. The legs 12 are not parallel. This feature helps to provide a space for the user to stand or land when jumping onto or off of the device 10. Optionally, there is a second crossbar 16 joining the two legs 12 at a point between the distal end 13 and the proximate end 14. Optionally, the legs 12 may feature one or more brackets 17 that serves as a means of attaching the device to the floor. The base 11 can optionally feature additional support for the device 10 in the form of an additional leg 12 extending from the first crossbar 15 away from the base 11 in a direction opposite the direction the legs 12 extend. In preferred embodiments, this leg is T-shaped and thus is referred to as a T-bar 18 and is configured to fold upward toward the rest of the device when the user needs it out of the way. Specifically, the T-bar 18 is pivotably attached to the base of the device and locked in place using a bolt or pin 19 inserted through a hole in the link between the T-bar 18 and the rest of the device.

FIG. 1 also shows the back frame 20 of the device 10. Protruding from and attached to the first crossbar 15 located at the distal end 13 of each of the legs 12, are a set of vertical supports 21. Typically, these vertical supports 21 will be attached to either end of the first crossbar 15 although, a skilled artisan can appreciate a number of other configurations such as attaching the vertical supports to the distal ends 13 of each leg 12. The vertical supports 13 extend upward and away from the first crossbar 15 to which they are attached to meet and attach to a horizontal support bar 23. In addition, preferred embodiments have a set of handlebars 15 that extend up and away from the legs 12 of the base 11. Again, a number of different configurations can be used to provide the user with structure(s) that they can grip with their hands when using the device 10. Specifically, in this embodiment, handlebars 24 are attached at one end to the horizontal support bar 23 and at the other end to the base 11 of the device 10. The handlebars 24 extend horizontally away from the horizontal support bar 23 for a distance before curving downward to meet the base 11 of the frame at a point that is forward of the vertical supports 21. FIG. 1 also shows the housing 34 that housing the counterweight 35 system discussed in more detail below.

Figure 2:
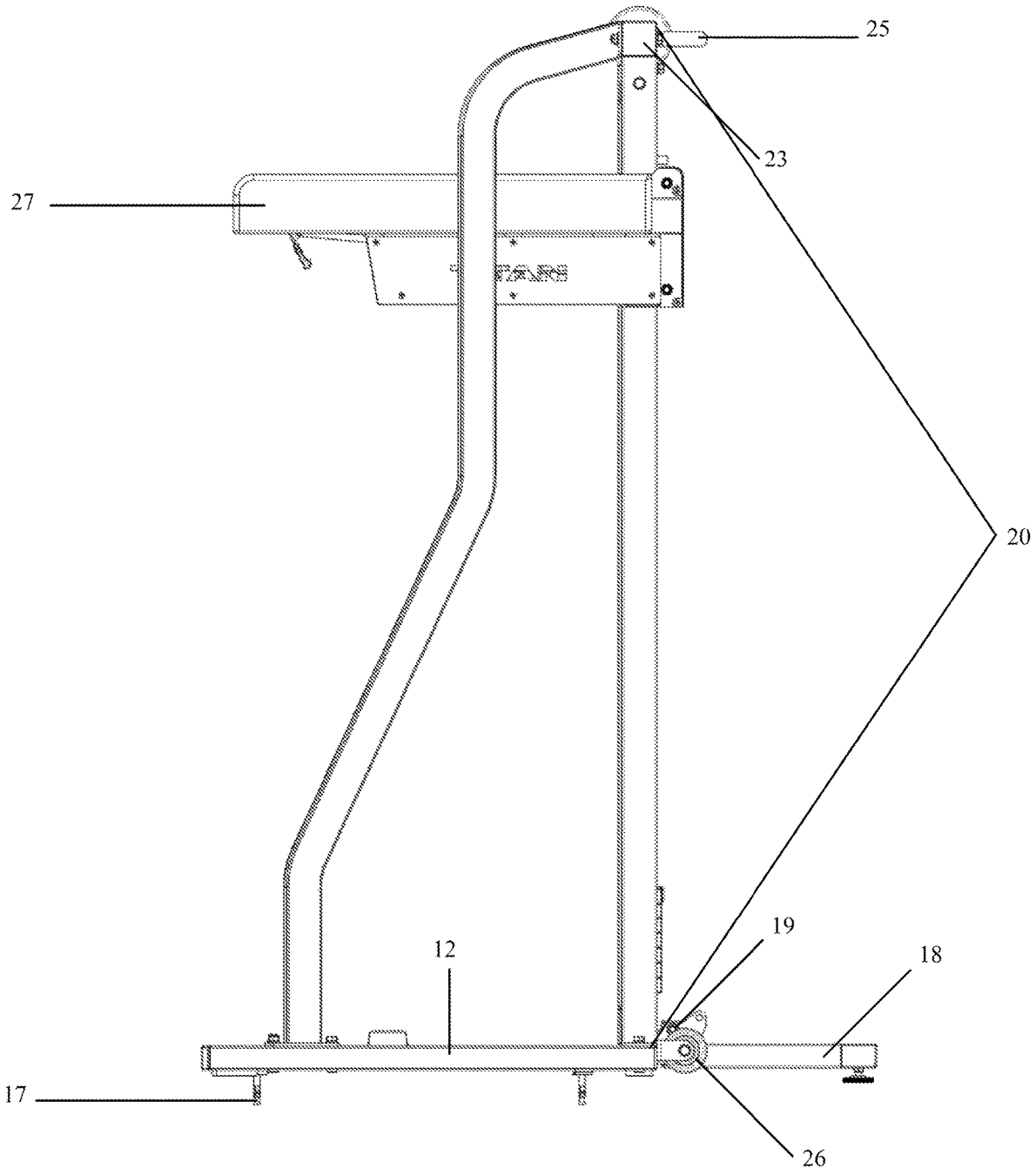
FIG. 2 is a side view of the same embodiment of device.

Further, as seen in FIG. 2, the horizontal support bar 23 may feature a handle 25 extending away from the back frame 20. This handle 25 can be gripped to make it easier to move the device. Moreover, the base 11 of the device 10 can also feature one or more wheels 26. In preferred embodiments, the wheels 26 are positioned on the back side of the first crossbar 15 that makes up part of the base 11 of the device. The device 10 can be moved much like a hand truck or dolly. First, the user removes the pin 19 from the link between the T-bar 18 and the base 11 of the device, then the user grips the handle 25 on the horizontal support bar 23 and pulls the handle 25 downward to tip the jump box 10 backward. While gripping the handle 25 the user can use the wheels 26 to move the device 10 to a new location.

Figure 3:
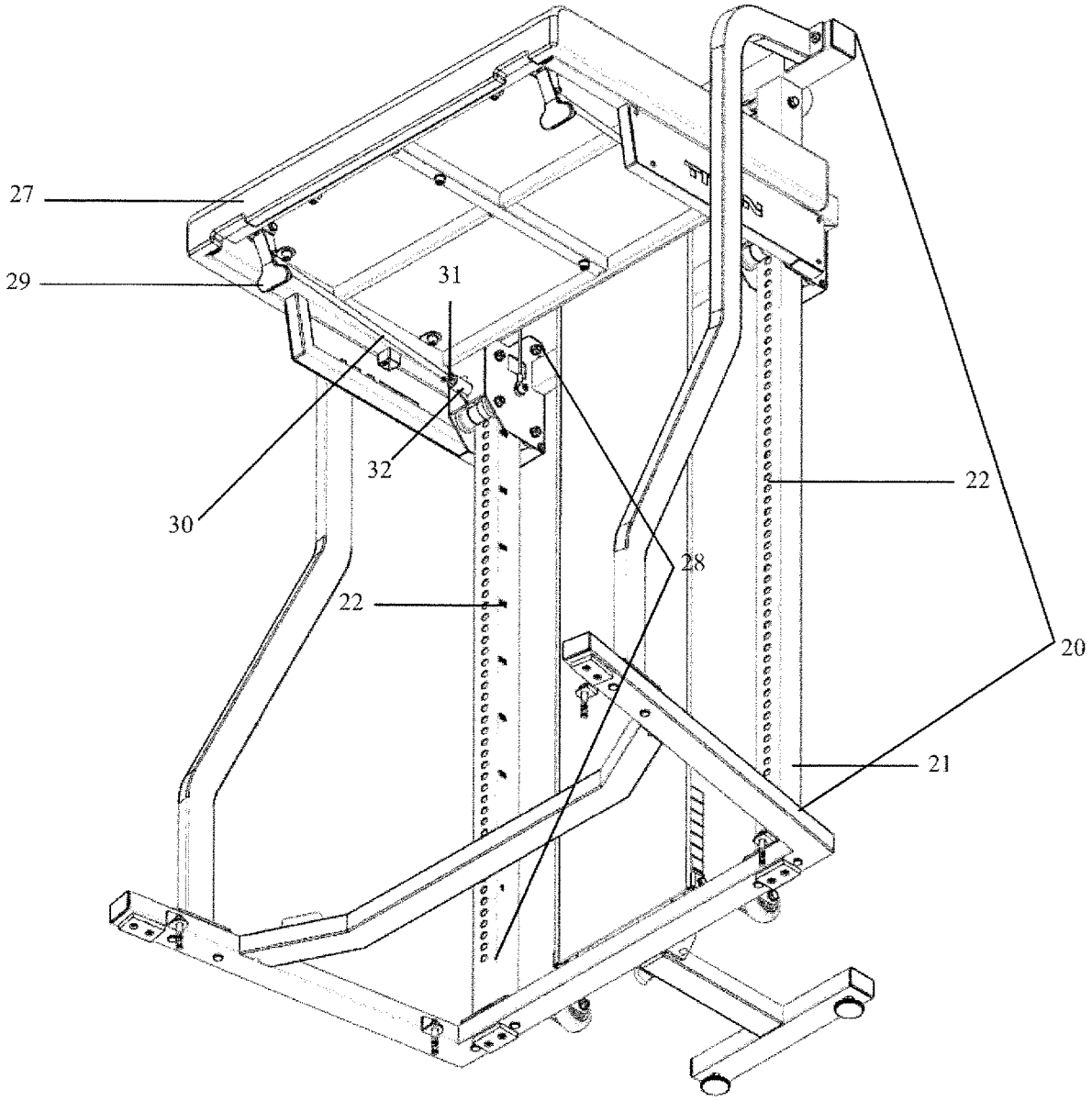
FIG. 3 is a bottom perspective view of the same embodiment of device.

The platform 27 is shown in more detail in FIG. 3. FIG. 3 shows a view of the device 10 from the bottom as if the device 10 were turned over. The platform 27 is made of a horizontally oriented frame that supports a flattened surface onto which the user jumps. The back of the platform 27 is adjacent to the adjustment system 28 on the vertical supports 21 back frame 20 of the jump box 10.

In preferred embodiments and the anticipated best mode of this device, the platform 27 is angled downward slightly toward the athlete to make it easier and safer for the athlete to jump onto the platform 27 but not so much that the athlete can knock the platform 27 over by landing in correctly. This downward angle is less than 5 degrees, meaning the angle of the top of the platform to the back frame is between 85 and 90 degrees. The various components of the platform 27 are all one solid structure the height of which is adjusted as discussed below.

FIG. 3 also illustrates the portion of the adjustment system 28 featured on the underside of the platform 27 in some embodiments. A skilled artisan can appreciate the location of these structures can be varied. In the preferred embodiments and the anticipated best mode of the device, the adjustment system 28 is a series of holes 22 that are integrated into the vertical supports 21. Optionally, these holes 22 can be featured on a separate structure that is connected to the vertical supports 21 or some other portion of the back frame 20. The device uses one or more cables 30 that are operably connected to one or more pins 32 by springs 31. The pins 32 are configured to fit into the holes 22 on the vertical supports 21 of the back frame 20 to adjust the height of the platform 27. When the user pulls on tabs 29, they pull on the cables 30 causing the springs 31 to stretch and pull their respective pins 32 out of their holes 22. The user is then able to move the platform 27 up or down with respect to the vertical supports 21 featuring the adjustment system 28 and align it with another set of holes 22 on the same vertical supports 21. At that point, the cables 30 can be released, the springs 31 will relax and the pins 32 will insert into another set of holes 22 thereby supporting the platform 27 at a different height. In this manner, the user can change the height of the platform 27 in small increments. In preferred embodiments of this device, the holes 22 in the vertical supports 21 are located one inch apart thereby allowing the user to adjust the height of the platform 27 in one-inch increments. While there is a practical limitation to how close the holes 22 can be positioned to each other, a skilled artisan can appreciate that the increments by which the height of the platform 27 can be adjusted can be more or less than one inch. Preferred embodiments have a second set of holes 22 featured by the vertical supports 21 that are set more than one inch apart, ideally 5 inches apart, to allow for quicker height adjustments when desired.

Figure 4:
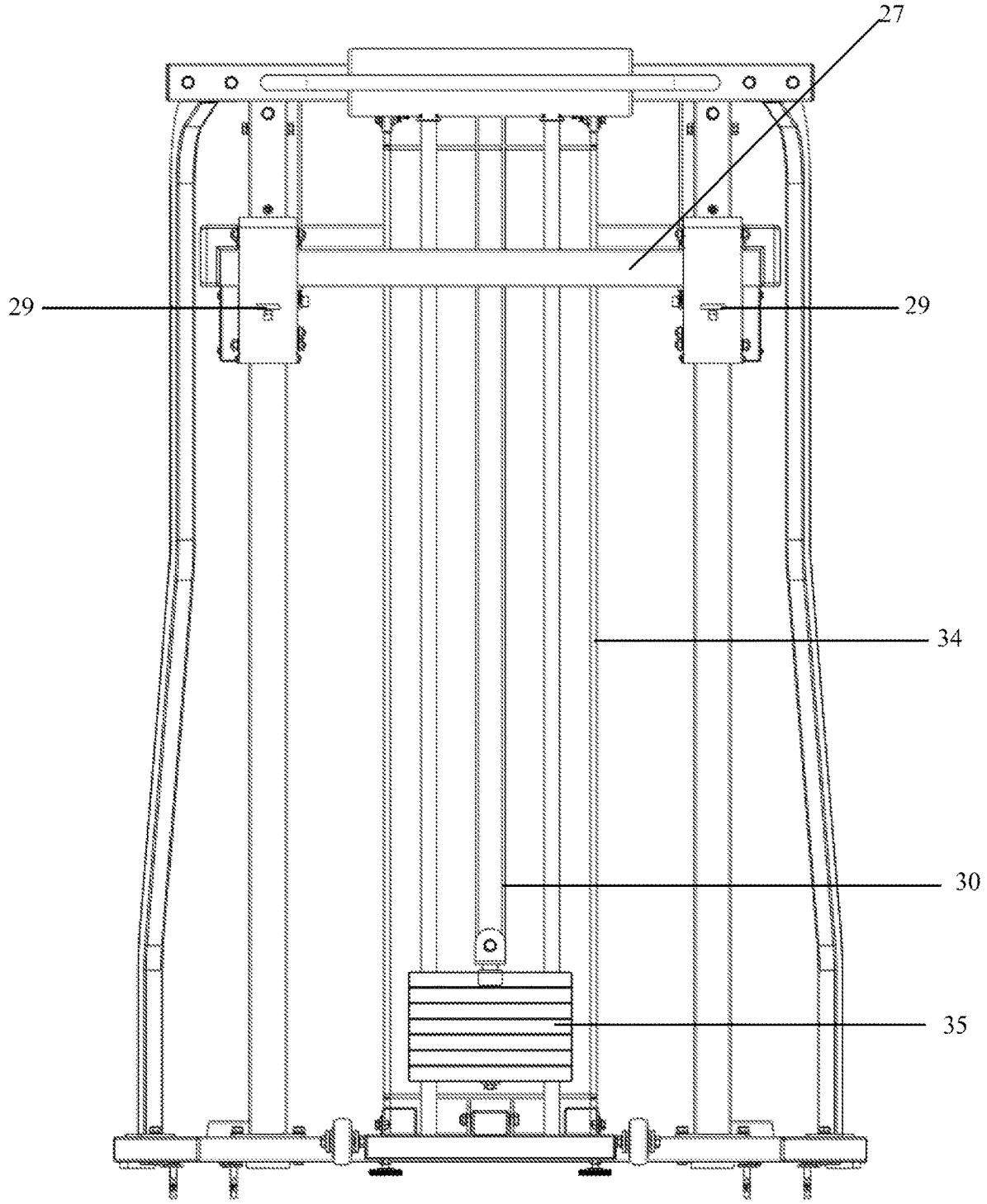
FIG. 4 is a rear view thereof.

FIG. 4 shows the jump box 10 from the back. Note, there is a second set of tabs 29 can be featured by the jump box 10. These tabs 29 also serve to allow the user to adjust the height of the platform 27 as discussed above. FIG. 4 also shows a cutaway of the housing 34 that houses the counterweights 35 that are operably connected to the platform 27 by one or more cables 30. The housing 34 can be open in the back or it can be a completely closed structure. The main purpose of the housing 34 is to prevent the user, or anything else, from accidentally coming into contact with the cables 30 or counterweights 35 when using the platform 27. The platform 27 is connected to these counterweights 35, so when the user detaches the platform 27 from the attachment system 28 featured by the vertical supports 21, at least part of the weight of the platform 27 is supported by the weights 35 making it easier for the user to move the platform 27 up and down and to hold it in place while the pins 32 are engaged with the attachment system 28.

Figure 5:
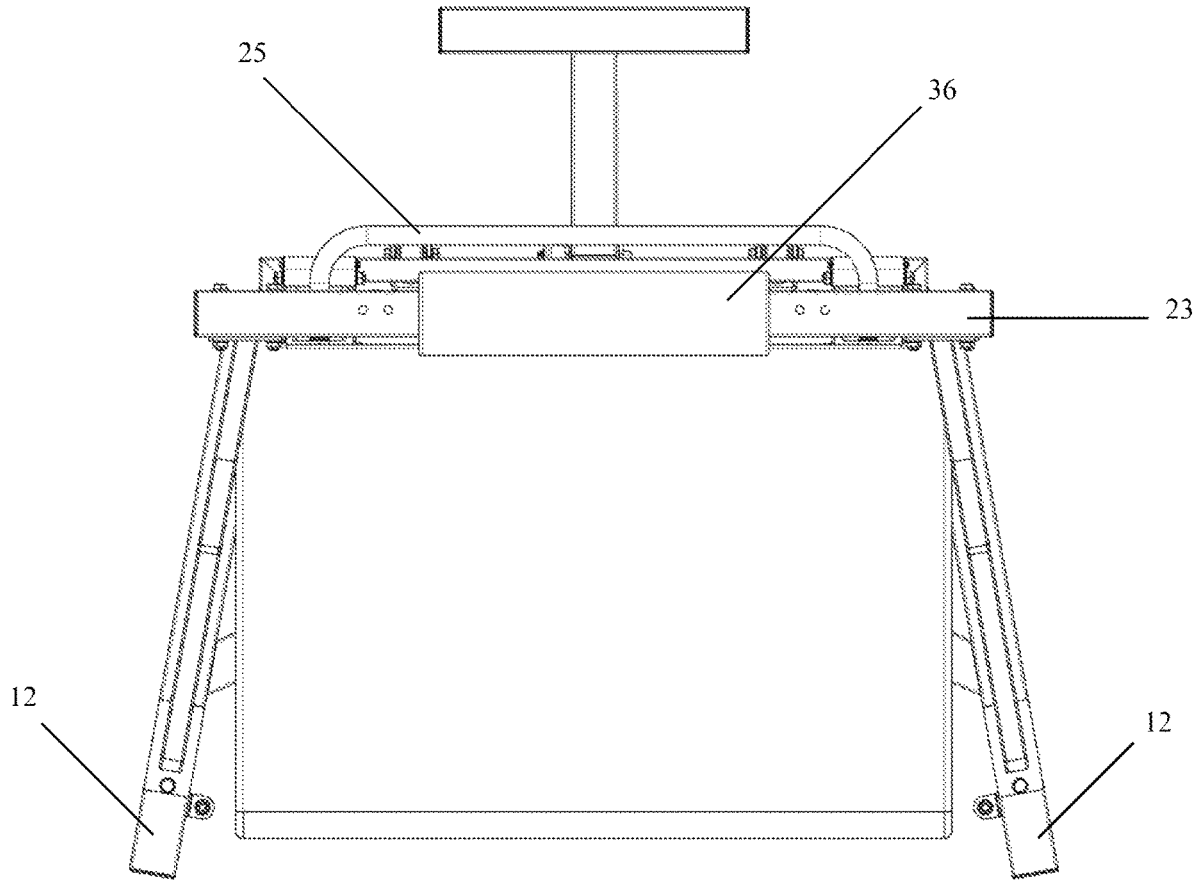
FIG. 5 is top-down view of the thereof.

FIG. 5 is a top down view of the jump box 10 and emphasizes the positioning of the legs 12 of the base 11. In particular, the legs 12 are not parallel with each other and flare outward as they extend away from the back frame 20 of the jump box 10. The legs 12 attach to the first crossbar 15 such that they form an obtuse angle with the same crossbar 15. This makes the jump box 10 wider at the front of its base 11 that it is at the back of its base 11. As discussed above, this "splaying" of the legs 12 gives the user more room to stand close to the jump box 10 when attempting a jump onto the platform 27. FIG. 5 also shows the horizontal support bar 23 featuring padding 36 and a handle 25 that can be used to tip the jump box 10 backward.

The advantages of the present invention include, without limitation, the ability to provide an athlete with a stable enough jump box to allow them to make high jumps with more safety and ease than any other method of jump boxing out on the current market. The box height will exceed over 80" at maximum height, this will be able to accommodate all different types of jump testing that is currently performed the field of personal training. This is the only box in the world that can accommodate all box jump testing methods quickly and safely, in one-inch increments. The adjustment system allows trainers to train athletes of different abilities quickly and efficiently. With this device a child could train with an NFL superstar with effortless and seamless transition between jumps. The pull pin mechanism that moves the jumping platform was designed for speed and efficiency and allows the strength coach to find the height the jumper needs in seconds. It is impossible to kick this device out and injure the jumper. If a jumper misses a jump the pad on the jumping platform makes it absolutely impossible for the athlete to get injured anywhere on the box.

The present invention is the only type of its kind. In an industry where millions are made by manufacturers and businesses manipulating the same pieces of equipment over the last 50 years, this piece of equipment stands alone. There is nothing like it on the market that can do what it does and provide the safety it does. The inventors put the athlete first designing this jump box. This is an invention that embodies 20 years of being a head strength for thousands of athletes. This piece of equipment could be one of the most important inventions in human performance this century.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above-described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention.

We claim:

1. A jump box for use in training comprising:

a base having a plurality of legs; and at least one pair of vertical supports wherein each vertical support in the at least one pair of vertical supports has a first end and a second end; wherein the first end of each of the vertical supports is directly attached to the base such that each of the vertical supports extends upward and away from the base; and wherein the second end of each of the vertical supports is attached directly to a horizontally oriented crossbar; and wherein the at least one pair of vertical supports has a height adjustment system integrated therein; wherein the height adjustment system comprises a plurality of holes featured by the at least one pair of vertical supports and at least one cable operably connected to at least one spring that is operably connected to a pin configured to fit into the plurality of holes, such that pulling on the at least one cable causes the spring to stretch producing a pulling force on the pin; and a flat platform attached to the at least one pair of vertical supports.

2. The jump box of claim 1 wherein each of the legs in the plurality of legs extends horizontally away from the horizontally oriented crossbar at an angle to the horizontally oriented crossbar of more than 90 degrees.

3. The jump box of claim 1 further comprising a T-shaped leg attached to the base and extending horizontally away from the base in a direction opposite the direction the legs extend away from the base.

4. The jump box of claim 1 wherein the platform is attached at a back end to the at least one pair of vertical supports and slopes downward as it extends away from the at least one pair of vertical supports.

5. The jump box of claim 4 wherein an angle between a bottom of the platform and the at least one pair of vertical supports is between 85 and 90 degrees.

6. The jump box of claim 1 further comprising a counterweight operably connected to the platform by one or more cables such that the counterweight applies a pulling force to the cable thereby supporting at least some of the weight of the platform.

7. A jump box for use in training comprising:

a base having a plurality of legs; and a first pair and a second pair of vertical supports wherein each vertical support in each pair of vertical supports has a first end and a second end; wherein the first end of each of the vertical supports in each pair of vertical supports is directly attached to the base such that each of the vertical supports in each pair of vertical supports extends upward and away from the base; and wherein the second end of each of the vertical supports in each pair of vertical supports is attached directly to a horizontally oriented crossbar;

a flat platform attached to the first pair of vertical supports; and a counterweight operably connected to the platform by one or more cables such that the counterweight applies a pulling force to the cable thereby supporting at least some of the weight of the platform.

8. The jump box of claim 7 wherein the platform has a front edge and a back edge wherein the platform is supported such that the front edge is lower than the back edge of the platform.

9. The jump box of claim 7 further comprising a T-shaped leg attached to the base and extending horizontally away from the base in a direction opposite the direction the legs extend away from the base.

10. The jump box of claim 7 wherein the first pair of vertical supports has a height adjustment system integrated therein; wherein the height adjustment system comprises a plurality of holes featured by the first pair of vertical supports and at least one cable operably connected to at least one spring that is operably connected to a pin configured to fit into the plurality of holes, such that pulling on the at least one cable causes the spring to stretch producing a pulling force on the pin.

* * * * *